US008118101B2

(12) United States Patent
Nelson et al.

(10) Patent No.: US 8,118,101 B2
(45) Date of Patent: Feb. 21, 2012

(54) BALL CATCHER WITH RETENTION CAPABILITY

(75) Inventors: Jonathan F. Nelson, Houston, TX (US); Gregory L. Hern, Porter, TX (US)

(73) Assignee: Baker Hughes Incorporated, Houston, TX (US)

( * ) Notice: Subject to any disclaimer, the term of this patent is extended or adjusted under 35 U.S.C. 154(b) by 263 days.

(21) Appl. No.: 12/511,148

(22) Filed: Jul. 29, 2009

(65) Prior Publication Data

US 2011/0024106 A1 Feb. 3, 2011

(51) Int. Cl.
*E21B 34/06* (2006.01)

(52) U.S. Cl. ..... 166/318; 166/373

(58) Field of Classification Search ..... 166/117, 166/318, 373, 386
See application file for complete search history.

(56) References Cited

U.S. PATENT DOCUMENTS

| | | | | |
|---|---|---|---|---|
| 4,436,151 | A | 3/1984 | Callihan et al. | |
| 4,754,814 | A | 7/1988 | Jordan, Jr. | |
| 4,901,794 | A | 2/1990 | Baugh et al. | |
| 4,934,459 | A | 6/1990 | Baugh et al. | |
| 6,732,793 | B1 | 5/2004 | Lee | |
| 6,920,930 | B2 | 7/2005 | Allamon et al. | |
| 7,055,610 | B2 * | 6/2006 | Vincent et al. | 166/386 |
| 7,416,029 | B2 | 8/2008 | Telfer et al. | |
| 7,530,400 | B2 | 5/2009 | Telfler | |
| 2011/0024106 | A1 * | 2/2011 | Nelson et al. | 166/117 |

OTHER PUBLICATIONS

Baker Oil Tools, Service Unit No. SU 10576, Catcher Sub Product Family No. H14077; Jul. 2007, 2 pages.
Imhoff, Jamie, et al., "Composites Improve Well Construction Efficiency", SPE 125084, Oct. 2009, 1-12.
Hupp, Jeffrey L., et al., "Improvements in Coiled-Tubing Window-Milling Operations Cut Costs and Increase Reliability, Prudhoe Bay, Alaska", SPE 68432, Mar. 2001, 1-4.
Sarber, Greg, et al., "The Side Exhaust Liner Running Tool: A Tool for Liner Running and Cementing Using E-Line Coiled Tubing", SPE 120992, Mar. 2009, 1-13.

* cited by examiner

*Primary Examiner* — Daniel P Stephenson
(74) *Attorney, Agent, or Firm* — Steve Rosenblatt

(57) ABSTRACT

A ball catcher is designed to stop balls that are the same size or different sizes at an inlet on a seat that is connected to a movable biased sleeve. Once the ball or other shaped object lands at the seat the flow around it increases differential pressure on the seat and sleeve and displaces them against the bias. The ball goes into a surrounding annular space and cannot exit. A preferably spiral sleeve guide the movement of the balls in the annular space so that efficient use of the annular space is made to maximize the number of balls that can be captured per unit length of the annular space. As soon as the ball enters the annular space the sleeve shifts back to the original position to stop the next ball at the inlet. Once in the annular space, the balls cannot escape if there is a flow reversal. The central passage remains open to pass other tools and flow.

20 Claims, 1 Drawing Sheet

BALL CATCHER WITH RETENTION CAPABILITY

FIELD OF THE INVENTION

The field of this invention is devices used in tubular strings to catch and retain objects previously dropped against a seat to operate a downhole tool and later ejected from the seat. More specifically, the present invention captures the ejected objects and preferably retains them outside a main bore regardless of the flow direction in the string.

BACKGROUND OF THE INVENTION

A tubular string extending downhole can have a plurality of seats that accept objects, usually spheres, which land on discrete seats so that pressure can be built up and a downhole tool in that string operated. The balls can be the same or different sizes as are the corresponding seats. Regardless of the configuration it is desirable after operating the downhole tool to eject the ball from a given seat by a variety of known techniques and then to capture the balls. The reason capturing the balls is a benefit is that if left in the tubular string and there is a reversal in flow direction the balls can flow backwards and get wedged or jammed. Ideally, capturing the blown out balls will leave a main flow bore through a ball catcher to allow other tools to pass such as those that are supported on wireline or coiled tubing, to provide some examples.

In one design offered by Baker Hughes Incorporated in Catcher Sub Product Family 14077, the central tube catches ejected balls or darts and the differential pressure that develops pushes the ball or dart further into the central tube with flow possible around the central tube. The central tube has a hook feature to prevent escape of the dart or ball if there is a flow reversal. This design left the central passage obstructed which hampered or prevented subsequent operations further downhole from the Catcher Sub. U.S. Pat. No. 6,920,930 captures a ball when landed on a seat and then the seat with the ball breaks one connection and pivots on a remaining connection out of a central passage to allow a shifting sleeve to come down to keep the ball and the seat that traps it out of a main central bore. U.S. Pat. No. 6,732,793 shows a ball retaining device against reverse flow in a ball catcher that locates the captured balls centrally. U.S. Pat. No. 7,416,029 illustrates providing a tortuous path for a deformable ball that moves through a deformable ball seat.

U.S. Pat. No. 7,530,400 shows a ball catcher that has a main bore 18 that is split into two parallel bores 26 and 28 with an entry plate sloping at the top that has openings 38 and 40 aligned with bores 26 and 28 respectively. Only small balls will fit through hole 40 and pass through bore 28 unobstructed. Bigger balls 50 that go through hole 38 are captured at the bottom of bore 26 by a restriction 42, 44. If a small ball 52 goes down passage 38 and into bore 26, it has a way to get from bore 26 to bore 28 as those bores overlap to create a pass through channel so that the small ball 52 can get into bore 28 and escape. There are several issues with this design. First, if there is a flow reversal it will force the balls uphole and out of the ball catcher. Second, the way this ball catcher is set up with parallel bores, it has to have the channel between the bores because it has no way to insure the small balls will go in the pass through passage 28. Another disadvantage is that it has a pass through passage for one size of ball as opposed to catching all balls that enter. While it is recognized that the latter may simply be a design objective when a ball catcher is applied to a specific tubular string, it is recognized that in other applications, this feature can be less than ideal.

The present invention is a ball catcher that is designed to collect and store all the balls that reach its entrance in an annular storage location that surrounds a main bore so that the main bore is left open for other tools to later pass. The annular space preferably has a spiral guide slot that is small enough to prevent the balls being used from exiting the annular space but that advances such balls as they arrive to make efficient use of the annular space. Arriving balls get stopped at the inlet where flow around them displaces a seat that originally stopped the ball and allows the ball to advance past the seat and into the annular space where it stays trapped. These and other features of the invention will become more readily apparent to those skilled in the art from a review of the description of the preferred embodiment that appears below with the associated drawings while recognizing that the full scope of the invention is given by the claims that are attached below.

SUMMARY OF THE INVENTION

A ball catcher is designed to stop balls that are the same size or different sizes at an inlet on a seat that is connected to a movable biased sleeve. Once the ball or other shaped object lands at the seat the flow around it increases differential pressure on the seat and sleeve and displaces them against the bias. The ball goes into a surrounding annular space and cannot exit. A preferably spiral sleeve guide the movement of the balls in the annular space so that efficient use of the annular space is made to maximize the number of balls that can be captured per unit length of the annular space. As soon as the ball enters the annular space the sleeve shifts back to the original position to stop the next ball at the inlet. Once in the annular space, the balls cannot escape if there is a flow reversal. The central passage remains open to pass other tools and flow.

DETAILED DESCRIPTION OF THE PREFERRED EMBODIMENT

Figure 2:
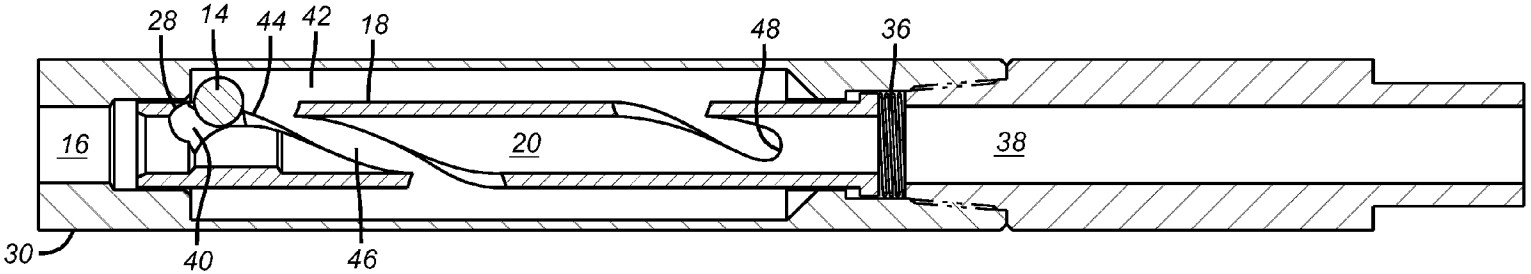
FIG. 2 is the view of FIG. 1 with the seat and sleeve shifted to allow the ball to move into the surrounding annular space.
Figure 3:
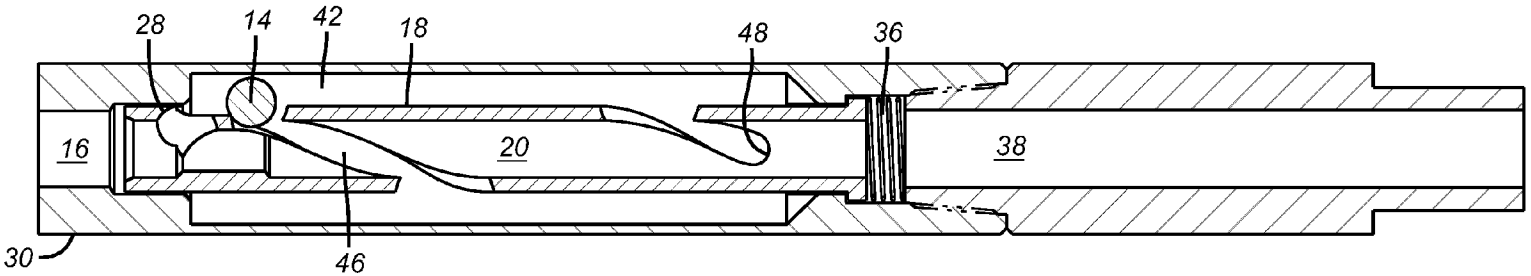
FIG. 3 is the view of FIG. 2 with the ball in the annular space and the seat and associated biased sleeve returned to the original position for the next ball.

The ball catcher 10 has an inlet 12 connected to a tubing string that is not shown. When the ball 14 passes through a ball seat (not shown) that is uphole it continues into inlet passage 16. A movable sleeve 18 has a passage 20 that extends from end 22 at the uphole end to end 24 at the downhole end. Toward the uphole end 22 the passage 20 has a reduced diameter section 26. Adjacent the reduced diameter section 26 is a lateral passage or exit 28 that is best seen in FIGS. 2 and 3 after the ball 14 has gone past. In the FIG. 1 position the housing 30 has a radial surface 32 and a cylindrical surface 34 adjacent and in an uphole direction. The ball 14 goes into the upper end 22 and cannot progress further down passage 20 because of reduced diameter section 26. There is enough room around the ball 14 when it engages reduced diameter section 26 to be pushed laterally against the lateral passage 28. This is the FIG. 1 position. Since the flow continues from inlet passage 16 a pressure differential develops on the ball 14 causing it to push against sleeve 18 and compress the return spring 36 mounted adjacent the outlet 38 to the housing 30.

Ball 14 and sleeve 18 move in tandem to the FIG. 2 position. In that position the ball 14 can advance down passage 40 because passage 40 has shifted with sleeve 18 to clear cylindrical surface 34 with lateral passage 28 and to compress spring 36 and now ball 14 has a clear passage into annular capture space 42. Once that happens the ball 14 is at the top 44 of spiral slot 46 that ends at lower end 48. The purpose of slot 46 is to increase the radial clearance between the outside diameter of sleeve 18 and the inside diameter of housing 30 so that the ball batcher 10 can capture the largest diameter ball 14 as possible. Slot 46 must be narrow enough to retain balls 14 as it guides the balls 14 that enter annular space 42. The spiral configuration of slot 46 maximizes the number of balls 14 that can be captured in annular space 42 for a given length of the annular space 42. The width of the spiral slot 46 does not exceed the size of constriction 26 ensuring that a ball 14 that was stopped by the constriction 26 will not fit through slot 46.

Figure 1:
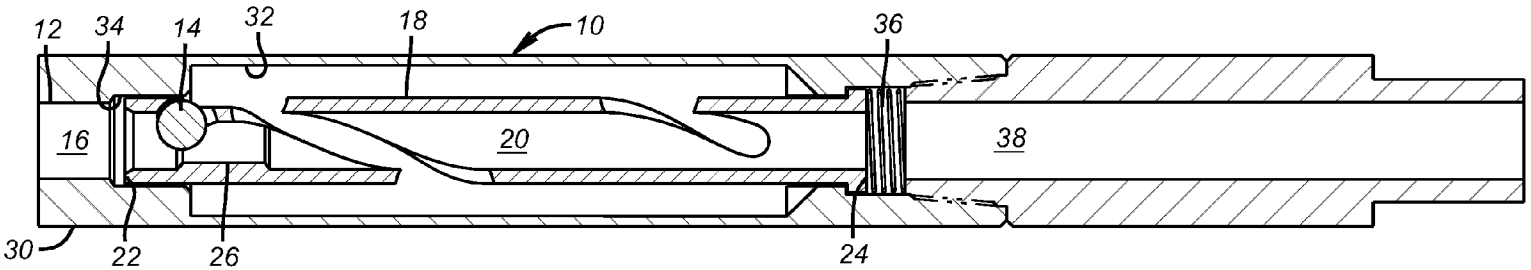
FIG. 1 is a section view of the ball catcher with a ball stopped on a seat near the housing inlet.

As soon as ball 14 rolls or is pushed into spiral slot 46, the spring 36 can return the sleeve 18 and the lateral passage 28 that moves with it back to the FIG. 1 position. The next ball simply repeats the process and follows the same path down spiral 46 until it lands on the ball already there at the lower end 48.

It is worth noting that the spiral groove 46 can have other configurations such as axial but it may be more limited in the number of balls 14 that it can hold for a given unit length of the housing 30. Groove 46 also allows fluid to pass as a way of advancing the ball 14 along the groove 46 using flow in a downhole direction from passage 16 to passage 38. The groove 46 serving as a ball guide is optional and that feature can be eliminated. A port from annular space 42 into the path 20 will also allow flow through the annular space 42 to move a ball 14 along in a more random path to the port that replaces the groove 46. In this case the port instead of the groove 46 should be smaller than the balls 14 that get trapped in the ball catcher 10. Such a port should be preferably located near the outlet passage 38 so that more of the annular space 42 can be used for storage of trapped balls 14.

Note that if balls 14 are used, the ball catcher can accommodate different diameters. If the reduced diameter section 26 is smaller than all the ball sizes used then they all will land on lateral passage 28 and all will be captured in annular space 42. Space 42 need not be annular and go around sleeve 18 for 360 degrees. Optionally, if in a given system balls below a given size do not need to be captured, then the reduced diameter section can be configured to exceed such a given size and balls smaller than that given size will just continue through and not land on lateral passage 28 and not go into annular space 42 to be captured. The passage 20 can be centrally disposed in the housing 30 so that other tools (not shown) can be delivered through passage 20 with wireline or coiled tubing or another known conveyance. Alternatively, it can be offset from the axis of housing 30. Although spheres 14 can be caught other shapes are envisioned including darts and wiper plugs or other shapes that can land in lateral passage such as 28 and enter the surrounding annular space 42. Spring 36 can be a coiled spring, a stack of Belleville washers or a variable volume chamber with a compressible fluid among other ways for creating a return bias force. Other ways to create the bias to the FIG. 1 position include using buoyancy of the sleeve 18 or a magnetic or some other type of field.

The above description is illustrative of the preferred embodiment and many modifications may be made by those skilled in the art without departing from the invention whose scope is to be determined from the literal and equivalent scope of the claims below.

We claim:

1. An apparatus for capturing at least one object moving in a tubular string, comprising:

a housing having an inlet connected to an outlet by a passage;

said passage further comprising a lateral exit into an adjacent space in said housing;

said lateral exit is opened by flow that brings said object into said passage, whereupon said object can pass into said adjacent space to be retained by virtue of the shape of said adjacent space.

2. The apparatus of claim 1, wherein:

said passage has an axis parallel with an axis of said housing.

3. The apparatus of claim 2, wherein:

said passage has an axis coincident with an axis of said housing.

4. The apparatus of claim 1, wherein:

said passage is constricted adjacent said lateral exit.

5. An apparatus for capturing at least one object moving in a tubular string, comprising:

a housing having an inlet connected to an outlet by a passage;

said passage further comprising a lateral exit into an adjacent space in said housing;

said lateral exit is opened by flow that brings said object into said passage, whereupon said object can pass into said adjacent space to be retained;

said passage stops the object while leaving space around the object for fluid flow through said passage.

6. An apparatus for capturing at least one object moving in a tubular string, comprising:

a housing having an inlet connected to an outlet by a passage;

said passage further comprising a lateral exit into an adjacent space in said housing;

said lateral exit is opened by flow that brings said object into said passage, whereupon said object can pass into said adjacent space to be retained;

said passage comprises a sleeve that shifts to open said lateral exit.

7. The apparatus of claim 6, wherein:

said sleeve is biased to close said lateral exit.

8. The apparatus of claim 6, wherein:

said lateral exit leads to a capture space within said housing;

said sleeve comprises a guide groove allowing fluid communication between said passage and said capture space but being small enough to preclude escape of the object into said passage.

9. The apparatus of claim 8, wherein:

said passage has a constriction adjacent said lateral exit;

said groove is no larger than said constriction and extends spirally along said sleeve.

10. An apparatus for capturing at least one object moving in a tubular string, comprising:

a housing having an inlet connected to an outlet by a passage;

said passage further comprising a lateral exit into an adjacent space in said housing;

said lateral exit is opened by flow that brings said object into said passage, whereupon said object can pass into said adjacent space to be retained;

said lateral exit is selectively obstructed by said housing.

11. An apparatus for capturing at least one object moving in a tubular string, comprising:

a housing having an inlet connected to an outlet by a passage;

said passage further comprising a lateral exit into an adjacent space in said housing;

said lateral exit is opened by flow that brings said object into said passage, whereupon said object can pass into said adjacent space to be retained;

said passage is constricted adjacent said lateral exit;

said lateral exit allows the object to shift laterally when encountering said constriction in said passage.

12. The apparatus of claim 11, wherein:

said lateral exit is blocked when said object shifts toward it after encountering said constriction in said passage.

13. The apparatus of claim 12, wherein:

said passage comprises a shifting sleeve with a lateral exit leading to a capture space with said lateral hole initially blocked by said housing.

14. The apparatus of claim 13, wherein:

said object moves toward said lateral exit so that flow through said passage moves said sleeve and the object in tandem to allow said object to pass though said lateral exit and into said capture space.

15. The apparatus of claim 14, wherein:

said lateral exit is sloped toward said housing outlet.

16. The apparatus of claim 14, wherein:

said sleeve comprises a guide groove to direct movement of the object in said capture space.

17. The apparatus of claim 16, wherein:

said guide groove fluidly communicates said passage and said capture space while retaining the object in said capture space.

18. The apparatus of claim 16, wherein:

said groove has a spiral shape.

19. The apparatus of claim 13, wherein:

said sleeve is biased so that said lateral exit is initially blocked;

said bias is overcome when said sleeve shifts with the object to allow the object to pass through said lateral exit.

20. The apparatus of claim 13, wherein:

said constriction defines the minimum object size that can be captured in said capture space.

* * * * *